United States Patent [19]

Purser

[11] Patent Number: 4,510,914

[45] Date of Patent: Apr. 16, 1985

[54] APPARATUS AND METHOD FOR PREPARING A MIXTURE OF COMBUSTIBLE LIQUID FUEL AND AIR

[76] Inventor: Ben D. Purser, 6659 Alanbrook Dr., Charlotte, N.C. 28215

[21] Appl. No.: 287,078

[22] Filed: Jul. 27, 1981

[51] Int. Cl.[3] ..... F02M 29/00

[52] U.S. Cl. ..... 123/590; 123/548

[58] Field of Search ..... 261/DIG. 21, 41 A, 41 B, 261/144, 145; 48/189.1, 189.4; 123/590, 548, 547, 591

[56] References Cited

U.S. PATENT DOCUMENTS

| | | | |
|---|---|---|---|
| 1,479,381 | 1/1924 | Good | 123/548 |
| 2,098,391 | 11/1937 | Irvin | 48/180 H |
| 3,057,335 | 10/1962 | Osborne | 123/591 |
| 3,554,174 | 1/1971 | Clawson | 123/545 |
| 3,618,577 | 11/1971 | Shaw | 123/548 |
| 3,851,634 | 12/1974 | Everett | 123/548 |
| 3,996,907 | 12/1976 | Marsee | 123/548 |
| 4,020,811 | 5/1977 | LaForce | 123/548 |
| 4,086,892 | 5/1978 | Marsee | 123/548 |
| 4,186,206 | 2/1980 | Matsumoto | 123/547 |
| 4,212,274 | 7/1980 | Quick | 123/548 |

FOREIGN PATENT DOCUMENTS

| | | | |
|---|---|---|---|
| 410739 | 6/1922 | Fed. Rep. of Germany | 123/548 |
| 2341315 | 2/1975 | Fed. Rep. of Germany | 123/591 |
| 230165 | 3/1925 | United Kingdom | 48/189.2 |

*Primary Examiner*—Ronald H. Lazarus

*Attorney, Agent, or Firm*—Richards, Shefte & Pinckney

[57] ABSTRACT

An apparatus and method of mixing liquid fuel and air for an internal combustion engine includes an assembly providing a plurality of venturi passageways for accelerative drawing of ambient air therethrough by the vacuum created by the engine and an associated fuel supply conduit system and apertures in the venturis for aspiration of fuel into the air. One of the venturis communicates unobstructedly with the engine to provide a fuel-air mixture for idling operation and a valve arrangement effects opening and closing of at least some of the other venturis to communication with the engine responsive to increases and decreases in the vacuum. An enlarged chamber intermediate the venturis and the engine receives the fuel entrained airstream from such some venturis, reduces the velocity thereof, and thereby gravitationally separates therefrom the larger fuel droplets which will not quickly and completely combust in the engine. A recycling arrangement returns the separated droplets to the atomizing assembly.

11 Claims, 11 Drawing Figures

APPARATUS AND METHOD FOR PREPARING A MIXTURE OF COMBUSTIBLE LIQUID FUEL AND AIR

BACKGROUND OF THE INVENTION

The present invention relates to internal combustion engines and particularly to apparatus and methods for preparing a mixture of a combustible liquid fuel and air for supply to and combustion in an internal combustion engine.

The mixing of a combustible liquid fuel in a predetermined proportion with air is an essential prerequisite to the proper functioning of conventional internal combustion engines. There conventionally exist several different types of apparatus and methods of preparing for and supplying to such engines a combustible mixture of fuel and air, e.g. carbureators and so-called "fuel injection" systems, each of which basically functions to atomize liquid fuel and entrain it in a predetermined ratio with ambient air. With the increases in recent years in the prices of gasoline and other combustible fuels traditionally utilized in the operation of conventional internal combustion engines, a considerable amount of developmental work has been undertaken toward the conservation and more efficient use of such fuels in such engines with a significant degree of such development work being directed toward the improvement of conventional devices and methods for mixing fuel and air.

Since the basic theory of operation of internal combustion engines requires that the fuel and air mixture be suitable for very quick, substantially complete combustion thereof within the combustion chamber or chambers of the engine, the nature of the fuel and air mixture and the size of fuel particles therein has a direct effect upon the efficiency of the combustion performed in the engine and, therefore, upon the fuel consumption of the engine. While the complete vaporization of conventional liquid fuel into its gaseous state in theory best prepares the fuel for quick, complete combustion, the limitations and operational requirements of conventional internal combustion engines, particularly the fixed swept volume of any such engine and the operational requirement of any given engine of a combustion mixture of a predetermined amount of fuel with a predetermined proportionate amount of air, present substantial practical problems in the utilization in a conventional internal combustion engine of a fuel vaporization arrangement. As will be understood, the vaporization of liquid fuel significantly increases the volumetric area occupied by the fuel and accordingly the volumetric area occupied by a mixture of a given amount of the particulate fuel with a given proportionate amount of air is correspondingly increased upon the vaporization of the fuel particles of the mixture. As a result of this inherent increase in volume upon the vaporization of liquid fuel and because of the fixed swept volume of any given internal combustion engine, the operation of the engine on a mixture of vaporized fuel and air necessitates the use of a smaller amount of fuel and air than would be used if the fuel were particulate in nature, thereby to maintain the desired air-to-fuel ratio. As a result, the total vaporization of fuel in a conventional internal combustion engine generally results in undesirably low power output and may additionally increase the fuel use of the engine. Accordingly, it is conventional wisdom that, while the partial vaporization of liquid fuel in the fuel-air mixture utilized in the conventional internal combustion engine will enhance the operation of the engine, the fuel in the mixture should be primarily particulate in nature. As a corollary, it is most desirable that the individual fuel particles of any such mixture be as small in volume as possible to best facilitate quick and complete burning thereof in the engine for the two-fold purpose of achieving the maximum force from the combustion and to minimize the amount of fuel waste from unburned fuel in the mixture, and preferably, some degree of vaporization of the smaller liquid fuel particles in the mixture will occur to enhance this desired result.

As will additionally be understood, the incomplete or inefficient combustion of fuel caused by either the total vaporization of the fuel or the atomization thereof into undesirably large droplets is a significant causative factor in the production in conventional internal combustion engines of undesirably high quantities of environmentally harmful products of combustion such as carbon monoxide, oxides of nitrogen, and hydrocarbons. Because of the magnitude of atmospheric pollution of this sort caused on a nationwide scale by the daily use of automobiles, legislative controls have been enacted to limit the maximum amount of such pollutants which any given automobile engine can exhaust into the atmosphere. To meet these standards, most automobile manufacturers have turned to the utilization of apparatus in the engine exhaust systems thereof particularly arranged to catalytically convert such pollutants into less harmful substances. While such apparatus are genrally effective for this purpose, they have been found to significantly reduce the fuel economy of the engines.

Pursuant to the above-listed basic criteria for efficient fuel consumption in internal combustion engines, virtually all apparatus and methods of preparing a fuel and air mixture therefor operate to entrain in ambient air a particulate mist of the fuel. A considerable degree of the development work toward the improvement of such apparatus and methods has heretofore been directed to maximizing the efficiency of the means and methods by which the liquid fuel is atomized or otherwise converted to a mist to reduce as much as possible the quantity of individual fuel particles in the mist which are of a size too large for substantially complete combustion in the engine. However, it is clear that no such improvement can possibly operate with total and complete efficiency and, therefore, all such systems presently known necessarily will produce at least some quantity of large particles which will not be completely combusted in an internal combustion engine.

It is therefore an object of the present invention to provide a method and apparatus for operation in combination with any conventional means of preparing a mixture of air and particulate fuel which will effectively separate and salvage from the mixture any fuel particles therein which are too large to be quickly and completely combusted in the engine whereby the air and fuel mixture supplied to the engine will be substantially completely combusted therein, providing increased fuel economy and a significant reduction in the production of harmful pollutants as a result of the combustion.

SUMMARY OF THE INVENTION

Briefly described, the present invention provides an apparatus and method for preparing a mixture of combustible liquid fuel and air for supply to an internal combustion engine wherein liquid fuel is atomized into a plurality of droplets including droplets of a sufficiently small size for substantially complete combustion in the internal combustion engine and the droplets are entrained in a moving airstream, and the fuel entrained airstream is then received by and directed through an arrangement providing an enlarged chamber for reducing the velocity of the airstream to allow fuel droplets larger than the aforesaid small size to separate from the airstream and collect in the chamber while the small fuel droplets remain entrained in the airstream for direction to the engine for efficient and substantially complete combustion therein.

Preferably, the arrangement receiving and directing the fuel entrained airstream is arranged to cause the airstream to flow in one direction through the enlarged chamber and in a different direction in flowing therefrom to enhance the reduction of the airstream velocity and thereby facilitate the separation therefrom of the larger droplets, and four specific embodiments of the enlarged chamber of this arrangement are presently contemplated. In one embodiment, a generally vertically-oriented, tubular housing member defines therewithin the chamber and has disposed therein an inverted tubular interior baffle having the end thereof facing the upper end of the housing member closed and the other end open. The housing member is arranged such that the airstream enters the chamber at the upper end thereof to cause the fuel entrained airstream to flow initially downwardly toward the lower end of the housing member and subsequently upwardly within the baffle member. An exhaust tube extending through the housing transversely of its tubular extent and communicating interiorly with the baffle at its closed upper end is provided for conveyance of the airstream from the chamber. In a modified embodiment, the interior baffle is omitted and the housing member is arranged such that the airstream enters the chamber transversely thereof adjacent its lower end and flows generally upwardly through the chamber to the exhaust tube. In a third embodiment, the housing extends substantially horizontally and is arranged to cause the airstream to flow generally horizontally through the chamber and generally vertically therefrom. In a fourth embodiment, an arrangement is provided defining a plurality of airstream flow paths arranged for flow of the airstream successively therethrough. A port is provided in each flow path for exhausting therefrom the airstream, the port in the last flow path communicating with the engine and the port in each other flow path communicating with the next succeeding flow path, and a generally horizontal baffle is provided in association with each such port for directing the airstream thereover into the port and to collect the larger droplets therebelow. Preferably, the flow paths are generally circular and are arranged concentrically and in a manner to cause the airstream to flow therethrough generally horizontally.

In the preferred embodiment of the present invention, the arrangement receiving and directing the fuel entrained airstream is adapted to be operatively associated with the internal combustion engine in a manner such that combustion of the fuel in the engine and exhaustion of the products of such combustion from the engine create a partial vacuum in the airstream receiving and directing arrangement and in the atomizing apparatus to draw ambient air into the atomizing apparatus for creating the moving airstream. According to another feature of the present invention, a particular preferred assembly is provided for atomizing and entraining the fuel in the moving airstream in droplets predominantly of the aforesaid small size and defines for such purpose a plurality of venturi passageways each communicating with ambient air for accelerative flow therethrough of such air to create a plurality of moving airstreams. An appropriate network of conduits and apertures is provided in the atomizing and entraining assembly for flow therethrough and aspiration therefrom of fuel into each of the airstreams. To continuously provide to the engine a sufficient fuel-air mixture for idling operation of the engine, one of the passageways communicates unobstructedly with the engine and a valve arrangement is associated with at least some of the remaining passageways for opening and closing such pasageways to communication with the engine in a predetermined sequence in relation to increases and decreases, respectively, in the partial vacuum in the atomizing and entraining assembly. Preferably, another of the remainder of the passageways also communicates with the engine for idling operation thereof, a valve being provided for closing the another passageway to communication with the engine when the engine surpasses a predetermined level of a selected engine heat factor. In the preferred embodiment, a plenum is formed intermediate the some passageways and the engine and the valve arrangement includes a sensor for sensing changes in the partial vacuum in the plenum and an appropriate linkage associated with the sensor for opening and closing the some passageways responsively to the sensed vacuum changes. A primary valve is disposed upstream of the plurality of venturi passageways for varying the degree of communication of the atomizing and entraining assembly with ambient air in response to changes in the partial vacuum in the engine at the location at which the airstream enters the engine. To enhance the atomization of fuel and to prevent the freezing of atomized fuel, a passageway extends through the atomizing and entraining assembly adjacent the venturi passageways and an arrangement is provided for conveying a heated fluid through the conduits to heat the fuel.

According to the preferred embodiment, fuel is supplied to the atomizing and entraining assembly by a pump operative to convey the fuel from a supply source to a fuel supply chamber intermediate the supply and the atomizing and entraining assembly in which chamber the fuel is transiently stored and from which it is gravitationally fed to the atomizing and entraining assembly, a valve arrangement in the supply chamber regulating the flow of the pumped fuel thereinto in relation to the rate of gravitational flow therefrom. This fuel supplying arrangement and the atomizing and entraining assembly are cooperatively arranged to feed to and entrain in the airstream an oversupply of fuel droplets sufficient to provide a predetermined proportionate quantity of the small fuel droplets in the airstream to compensate for separation in the enlarged chamber of the larger droplets. The present invention also provides for the recycling of the separated larger droplets by withdrawing the collected larger droplets form the enlarged chamber to a collection sub-chamber and redirecting such collected fuel droplets through the atomizing and entraining assembly.

DESCRIPTION OF THE PREFERRED EMBODIMENT

Figure 1:
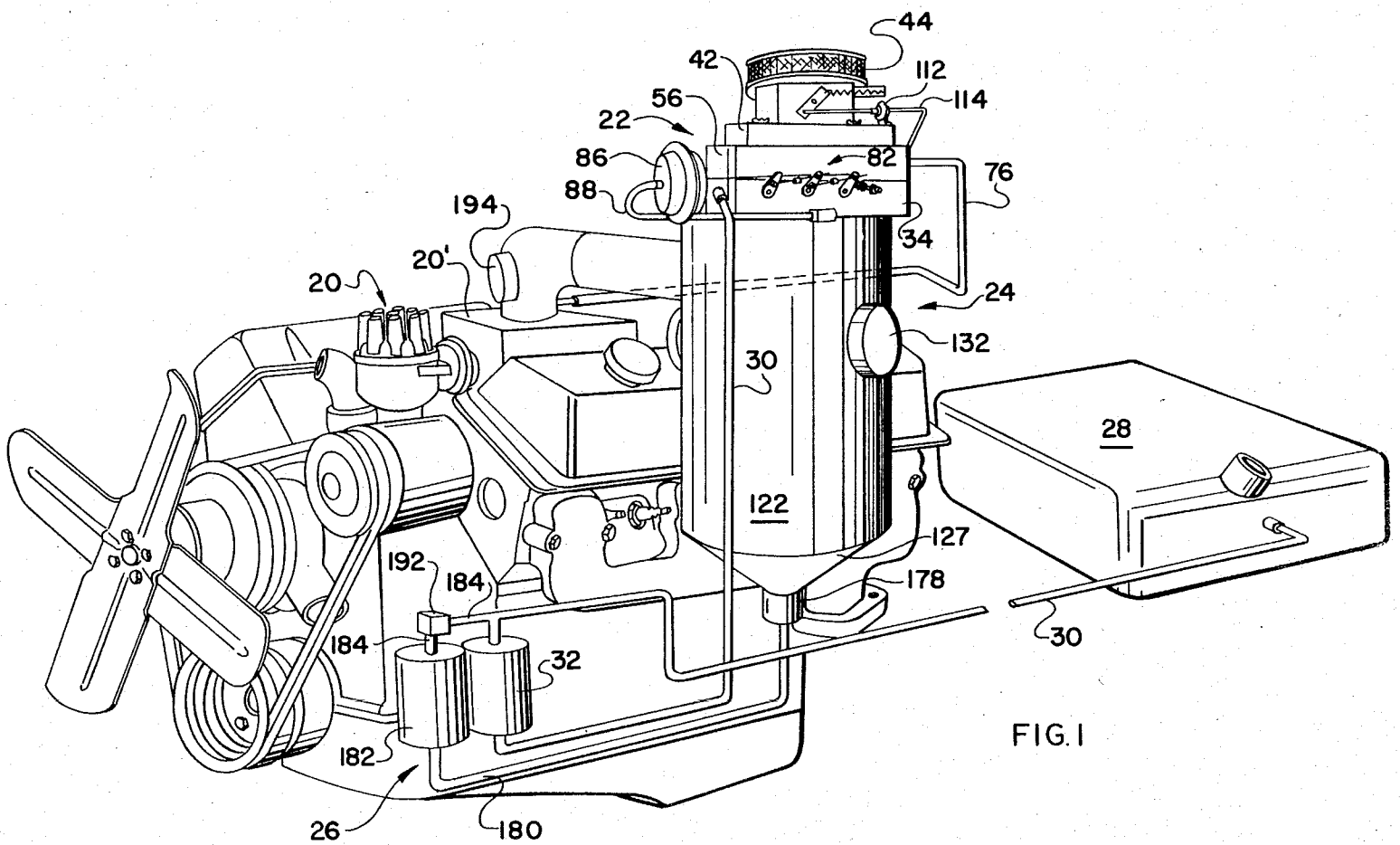
FIG. 1 is a perspective view of an internal combustion engine incorporating the preferred embodiment of the present invention.
Figure 2:
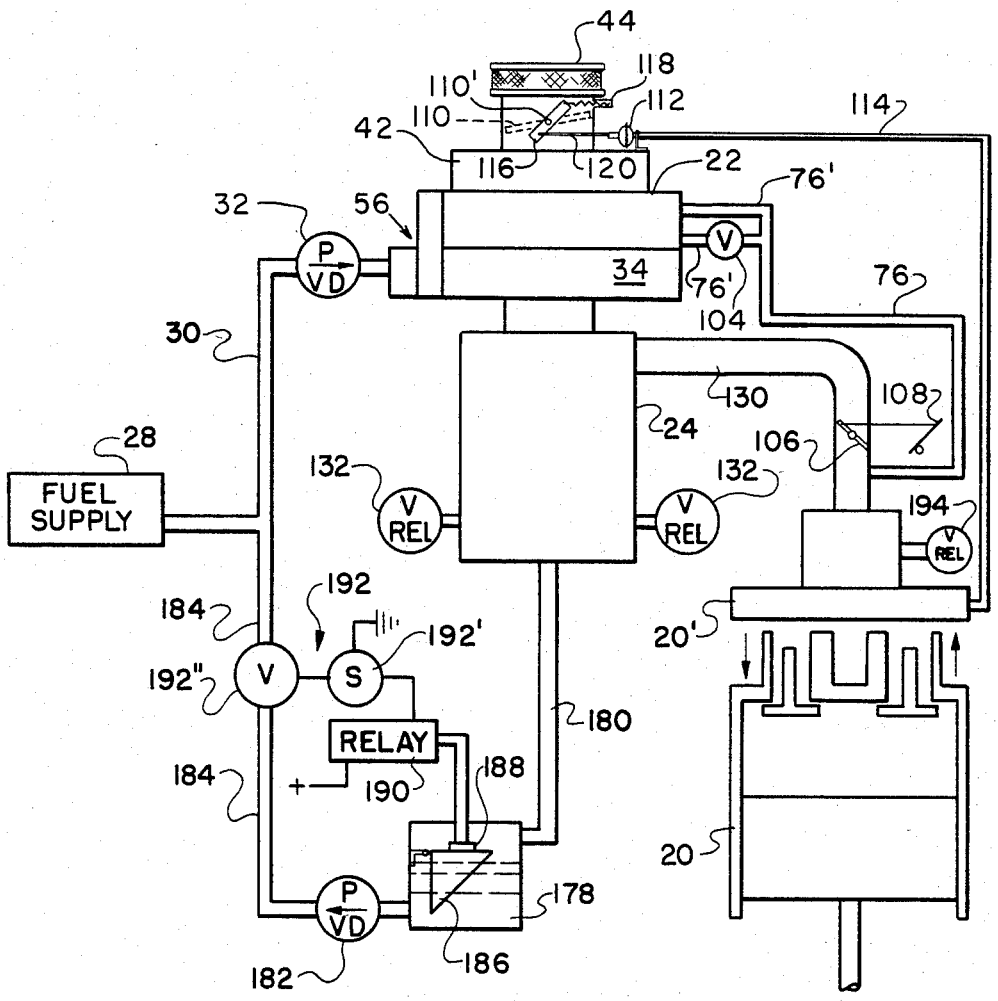
FIG. 2 is a schematic diagram of the preferred embodiment of the present invention.

Referring now to the accompanying drawings, the apparatus and method of the present invention for preparing a mixture of a combustible liquid fuel and air for supply to an internal combustion engine is illustrated in its preferred embodiment in a conventional gasoline-burning automobile engine, indicated generally in FIG. 1 and symbolically in FIG. 2 at 20. The present invention basically includes an assembly for atomizing liquid fuel into particulate droplets and entraining such droplets in a moving stream of ambient air, indicated generally at 22 in FIGS. 1 and 2, and an arrangement disposed intermediate the atomizing and entraining assembly 22 and the engine 20 in communication with both thereof for receiving the fuel entrained airstream from the atomizing and entraining assembly 22, removing from the airstream fuel droplets of a size too large for substantially quick and complete combustion in the engine 20, and then directing the fuel entrained airstream to the engine 20, such arrangement being generally indicated at 24 in FIGS. 1 and 2. A fuel supplying arrangement 26 is operably associated with the fuel atomizing and entraining assembly 22 and the airstream receiving and directing arrangement 24 to provide fuel thereto as required, this arrangement 26 including a fuel tank 28, an appropriate tubular conduit 30 communicating between the tank 28 and the fuel atomizing and entraining assembly 22, and a conventional fuel pump 32, the particular construction of which is not critical and forms no part of the present invention, operatively associated with the conduit 30 for positively conveying fuel therethrough from the tank 28 to the atomizing and entraining assembly 22.

As will be understood to be conventional practice, the atomizing and entraining assembly 22 communicates with ambient air and the preferred embodiment of the present invention is arranged in association with the engine 20 such that the combustion of the fuel and air mixture in the combustion chamber or chambers of the engine 20 and the exhaustion of the products of such combustion therefrom create a partial vacuum in the airstream receiving and directing arrangement 24 and the atomizing and entraining assembly 22 effective to draw ambient air into the atomizing and entraining assembly to create the aforesaid moving airstream. This aspect of the operation of the present invention is conventional and understood by those skilled in the art and, accordingly, will not herein be explained and described in detail except insofar as it particularly relates to the present invention and its operation.

As will be understood, quick and substantially complete combustion of an appropriate mixture of fuel and air is essential to the proper operation of an internal combustion engine and to a significant extent depends upon the atomization of liquid fuel into particulate droplets of a sufficiently small volumetric size that complete burning thereof will occur substantially instantaneously upon ignition in the combustion chamber of the engine thereby to achieve the maximum force from the combustion and to minimize fuel waste and atmospheric pollution from unburned or only partially burned fuel. According to one feature of the present invention, the fuel atomizing and entraining assembly 22 is effective for atomizing liquid fuel into particulate droplets predominantly of such a sufficiently small size for quick, substantially complete combustion upon ignition thereof in the presence of an appropriate proportionate quantity of air in a combustion chamber of a conventional internal combustion engine and for mixing such atomized fuel with such an appropriate proportionate quantity of air. According to another feature of the present invention, the receiving and directing arrangement 24 provides an enlarged chamber 24' through which the fuel entrained airstream passes and which is effective to separate therefrom the fuel droplets therein larger than the desired sufficiently small size. The term "sufficiently small size" and variations thereof used hereinabove and hereafter is intended to refer to that particular volumetric size and all smaller volumetric sizes at which particles of liquid fuel will combust substantially instantaneously and completely upon ignition in the combustion chamber of a given internal combustion engine. It is not considered possible to accurately measure fuel droplets in and conveyed from the apparatus of the present invention and thereby to define such term dimensionally, or otherwise quantitatively and, in any event, any such quantitative value would vary according to the particular fuel being used and upon the particular engine being used. However, the functioning of and results achieved in engines equipped with the apparatus and utilizing the method of the present invention can be determined empirically by observation, operational testing and evaluation of engine emissions. It is believed that, for substantially all conventional, mass-produced, gasoline-burning automobile engines, particulate droplets of approximately a diameter equal to or less than five thousandths of an inch (0.005"), or one hundred twenty-seven (127) microns, would sufficiently quickly and completely combust in an engine of such type to achieve desirable power, fuel economy and exhaust emissions results while droplets of any significantly larger size would deleteriously affect such results. Of course, it will be understood that the present invention can be adapted, without departing from the basic substance or concept thereof, to prepare and deliver to an internal combustion engine a fuel entrained airstream containing particulate droplets approximately equal to and smaller than any given predetermined, desired particle size, and the present invention is accordingly not intended to be limited in scope or applicability to the preparation of a fuel entrained airstream having droplets of any particular size.

Looking now to FIGS. 5–8, the fuel atomizing and entraining assembly 22 of the present invention is illustrated and includes a rectangular polyhedral block 34 adapted to be mounted on the receiving and directing arrangement 24 by a threaded collar 35 provided in the bottom surface of the block 34. Extending vertically through the block 34 from its upwardly facing surface are a plurality of cylindrical bores 36 in each of which is tightly slidably fitted on insert 38 having a central circular opening 40 taperingly converging from each end thereof to a central location of reduced cross-sectional area. The central opening 40 of each insert 38 communicates with the ambient atmosphere through a cap member 42 and a conventional air filter assembly 64, both mounted on the block 34 on threaded studs 46 extending upwardly therefrom, whereby the openings 40 form a plurality of venturi passageways capable of creating a respective plurality of acceleratively moving streams of ambient air when the aforesaid vacuum draw of the engine 20 is applied through the openings 40. The bores 36 are preferably spaced along the length of the block in pairs forming two rows and a fuel supply conduit 48 is formed longitudinally through the block 34 adjacent each row of bores 36 and communicates therewith through secondary conduits 48′ each of which extends vertically from its respective conduit 48 and opens horizontally into a respective one of the bores 36. In inserts 38 are annularly profiled at the respective exterior locations thereon positioned adjacent the opening of the secondary conduits 48′ into the bores 36 to define a circular fuel conduit 50 between each insert 38 and the wall of its bore 36 in open communication with the respective secondary conduit 48′ and conduit 48 with which each bore 36 is associated. Each insert 38 is additionally provided with a plurality of apertures 52 spaced annularly thereabout and extending radially therethrough from the annular profile thereof forming its circular conduit 50 to a location opening into the central passageway 40 thereof immediately downstream of the location of the reduced cross-sectional area of the passageway 40. Annular gasket rings 54 are provided exteriorly about each insert 38 on opposite sides of its exterior profiled section to seal the circular conduit 50 formed thereby.

A float chamber arrangement 56 is provided at one end of the block 34 for transiently storing fuel pumped from the tank 28 and supply such fuel to the venturi passageways along the conduits 48,48′,50 and the insert apertures 52. The float chamber arrangement 56 is of conventional construction and includes a substantially hollow housing 58 affixed to the end of the block 34 to define a fuel storage chamber 60. An inlet port 62 in the housing 58 communicates through the tubular duct 30 with the fuel pump 32 and the supply tank 28 and directs fuel into the chamber 60 through a passageway 64 extending from the inlet port 62 into the storage chamber 60. A float member 66 is pivotably mounted on a vertical wall of the housing 58 for pivotal movement thereabout in floating disposition at the upper level of fuel contained in the chamber 60, a sliding metering pin 68 being disposed in the passageway 64 and operatively resting on a support surface 66′ of the float member 66 for the actuation of sliding movement of the pin 68 in the passageway 64 in response to pivotal movement of the float member 66 caused by changes in the quantity of fuel contained in the chamber 60. To facilitate regulation of the flow of fuel into the chamber 60 in relation to the quantity of fuel in the chamber 60 and the rate of flow of such fuel therefrom, the upper end of the pin 68 is tapered and the inner surface of the passageway 64 is compatibly profiled at a selected location 64′ such that, when the fuel in the chamber 60 reaches a sufficient level to cause the float 66 to slidably move the pin 68 in the passageway 64 to such selected location 64′, the pin 68 will seat in the passageway thereat to prevent the flow of additional fuel into the chamber 60 until a sufficient quantity of the fuel therein is exhausted to cause the float member 66 to pivot downwardly and allow unseating of the pin 68. As will be seen in FIG. 6, the float chamber arrangement is constructed to maintain in such manner the level of fuel in the chamber 60 at a level intermediate the level of the fuel supply conduits 48 and the location of the circular conduits 50 whereby the fuel gravitationally flows into the vertical legs of the secondary conduits 48′. In this manner, application of the partial vacuum of the engine 20 to any of the venturi passageways and the creation thereby of accelerative airflow through such venturi passageway or passageways will draw the fuel in the associated secondary conduit or conduits 48′ into the respective circular conduit or conduits 50 to effect aspiration into the airstream of the fuel through the apertures 52 of the respective insert or inserts 38.

It is considered advantageous to provide at least some mixing of the fuel with ambient air prior to the mixing of the fuel with ambient air provided upon passage of the fuel through the apertures 52 and the venturi passageways thereby to enhance the overall mixing of the fuel with air. For this purpose, the vertical legs of the secondary fuel supply conduits 48 in the block 34 extend and open to the upwardly facing surface of the block 34 and each such vertical leg threadedly receives in the upper end thereof a screw 69 having an axial bore 69′ extending therethrough. In this manner, the vacuum draw of the engine 20 through any of the venturi passageways of the atomizing and entraining assembly 22 will also draw ambient air through the bore or bores 69′ of the screw or screws 69 in the associated secondary conduit or conduits 48′ whereby such ambient air will be drawn through the conduit or conduits 48′, the associated circular circuit or conduits 50, and the apertures 52 of the associated insert or inserts 38 and will be partially mixed with the fuel also being drawn therethrough as described above.

In the preferred embodiment of the atomizing and entraining assembly 22, at least one of the bores 36 is arranged such that the venturi passageway formed by the insert 38 in such bore 36 communicates unobstructedly with the intake manifold 20′ of the engine 20 bypassing the receiving and directing arrangement 24 to constantly provide to the engine 20 a sufficient mixture of fuel and air for idling operation of the engine 20 and at least some of the remainder of bores 36 are arranged such that the venturi passageways of the respective inserts 38 of such some bores 36 communicate with the receiving and directing means 24. As illustrated in FIGS. 5–8, eight bores and inserts 36,38 are employed to provide eight venturi passageways and, for the above-noted purpose, six of the bores 36 open into a plenum 70 formed in the block 34 below such bores 36 for flow thereinto and to the receiving and directing arrangement 24 through opening 70' of the airstreams drawn through the venturi passageways of the inserts 38 in such bores 36, while two of the bores 36 communicate through horizontal ports 72 with the exterior of the block 34, threaded tubular nipples 74 being provided in such ports 72 for operative communication of each of the ports 72 with respective legs 76' of one end of a tubular conduit 76 the other end of which opens directly into the intake manifold 20' of the engine 20.

Figure 5:
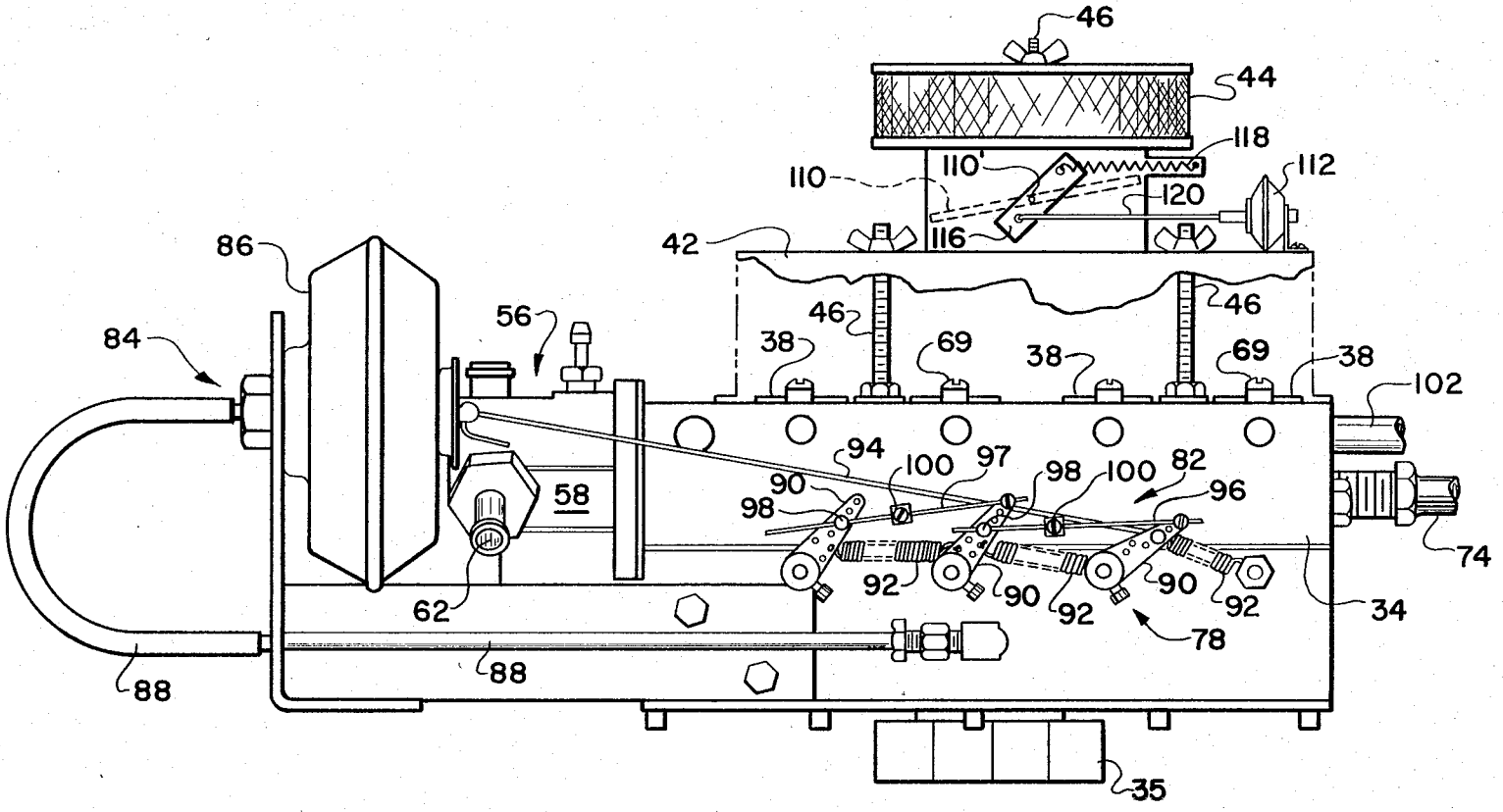
FIG. 5 is a side elevational view of the fuel atomizing and entraining assembly of the preferred embodiment of the present invention.
Figure 6:
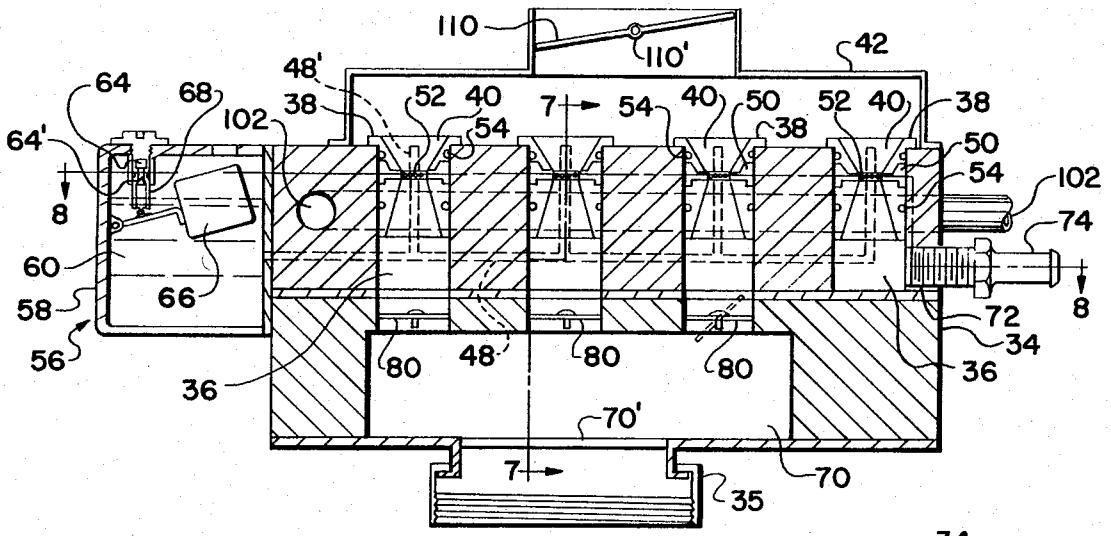
FIG. 6 is a vertical sectional view of the fuel atomizing and entraining assembly of FIG. 5 taken through one bank of the venturi passageways thereof.
Figure 8:
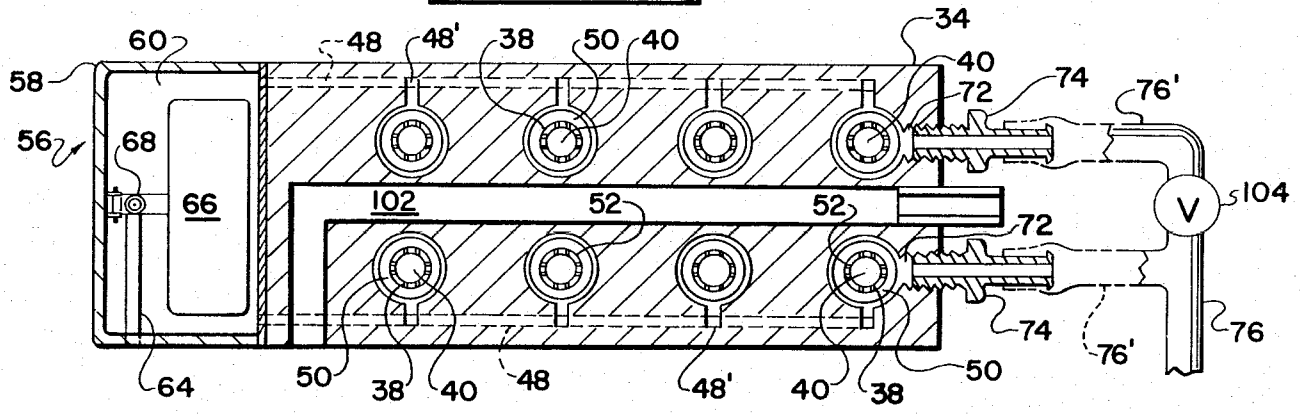
FIG. 8 is a horizontal sectional view of the fuel atomizing and entraining assembly of FIG. 5 taken along line 8—8 of FIG. 6.
Figure 7:
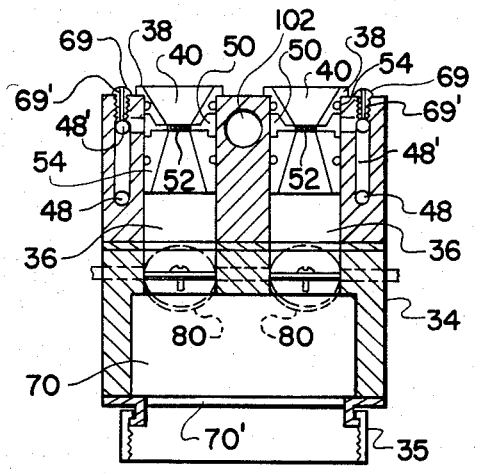
FIG. 7 is a vertical sectional view of the fuel atomizing and entraining assembly of FIG. 5 taken along line 7—7 of FIG. 6.

A valve arrangement, indicated generally in FIG. 5 at 78, is operatively associated with the six bores 36 for opening and closing their respective venturi passageways to communication with the plenum 70 in a predetermined sequence in relation to increases and decreases, respectively, in the partial vacuum drawn on the plenum 70 effected by the partial vacuum in the engine 20. For this purpose, a butterfly valve 80 is pivotally mounted on a horizontal axis in the lower end of each bore 36 at the location of communication thereof with the plenum 70, the butterfly valves 80 of each pair of bores 36 being rigidly mounted co-axially for associated pivotal movement, and a linkage mechanism 82 is provided on one exterior side of the block 34 in operative association with the respective axes of the butterfly valves 80 for operating the pivotal opening and closing movements thereof. A diaphragm-operated vacuum sensing arrangement 84 is provided for sensing changes in the partial vacuum in the plenum 70 and is operatively connected with the linkage mechanism 82 to control the operation thereof, the sensing arrangement 84 including a flexible diaphragm member 86 adapted for contraction and expansion in relation to the application of vacuum suction thereto and communicating with the plenum 70 through a tubular conduit 88 for application of the partial vacuum therein to the diaphragm member 86. The linkage mechanism 82 includes lever arms 90 rigidly affixed respectively to the axes of the butterfly valves 80 for actuating opening and closing movements thereof. Each lever arm 90 is biased toward a position closing its respective butterfly valves 80 by respective springs 92. A primary actuating link 94 extends between the diaphragm member 86 and the farthest spaced lever arm 90 (hereinafter termed the "first" lever arm, for convenience of discription) for actuating pivotal movement thereof against the biasing force of its associated spring 92 upon contraction of the diaphragm member 86 in response to increases in the partial vacuum in the plenum 70, thereby to open the butterfly valves 80 of the associated pair of bores 36 to permit the partial vacuum to draw ambient air through the venturi passageways of the two inserts 38 of such bores 36 to provide a fuel entrained airstream to supplement that provided by the venturi passageways of the two bores 36 providing fuel and air for idling. Respective connecting links 96,97 extend between the first lever arm 90 and the adjacent, or "second", lever arm 90, and between the second lever arm 90 and the other, "third" lever arm 90, the connecting links 96,97 being pivotally affixed, respectively, to the ends of the first and second lever arms 90 and extending slidably through appropriate respective openings in studs 98 affixed respectively to the second and third lever arms 90. Each of the connecting links 96,97 is provided with an abutment member 100 rigidly affixed thereto at a selected location thereon for abutting the stud 98 through which it slidably extends to sequentially actuate pivotal movement of the second lever arm 90 following a predetermined degree of pivotal movement of the first lever arm 90 and of the third lever arm 90 following a predetermined degree of pivotal movement of the second lever arm 90, all in response to the contraction of the diaphragm member 86 and in relation to the degree thereof. In this manner, increases in the partial vacuum in the plenum 70 as effected by the partial vacuum of the engine 20 cause sequential opening of the venturi passageways of the bores 36 in pairs to appropriately supply to the engine 20 through the receiving and directing arrangement 24 a greater quantity of fuel and air as so determined by the need of the engine therefor.

Those skilled in the art will thus understand that the provision by the atomizing and entraining assembly 22 of eight venturi passageways and the above-described arrangement thereof for opening and closing thereof to communication with the engine in a predetermined sequence relative to changes in the partial vacuum in the plenum 70 permits the accurate regulation of the quantity of fuel and air supplied to the engine 20 in close relation to the need therefor. In complement of and to better facilitate such regulation, each of the venturi passageways is also constructed to have a substantially smaller cross-sectional area at its location of reduced cross-sectional area and relatively smaller apertures 52 than is provided by conventional apparatus. Preferably, the venturi passageways of the inserts 38 of the two "idle" bores 36 have respective diameters at their location of reduced cross-section of approximately two hundred thousandths of an inch (0.200") and the location of reduced cross-sectional area of the remaining venturi passageways of the inserts 38 of the other bores 36 are of respective diameters of approximately three hundred thousandths of an inch (0.300"). The apertures 52 of all of the inserts 38 are approximately twenty-eight to thirty thousandths of an inch (0.028" to 0.030"). In this manner, the venturi passageways of the atomizing and entraining assembly 22 are effective to cause the ambient airstreams drawn therethrough to accelerate to velocities significantly greater than are created in conventional apparatus and to aspirate from the apertures 52 particulate fuel droplets considerably smaller than are provided by conventional apparatus and accordingly are operative to provide a fuel entrained airstream composed predominately of fuel droplets of the aforesaid sufficiently small size.

As will be understood, the atomized mist of fuel emitted through the apertures 52 of the inserts 38 may tend to freeze in cold weather and may cause clogging of the apertures 52. To alleviate this problem, a passageway 102 is provided centrally through the block 34 for flow therethrough of heated fluid, preferably as an operative portion of the radiator system of the automobile engine, to maintain the block 34 and the fuel therein at a sufficient temperature to resist freezing. Because the heated fuel will tend to vaporize more readily, this feature of the atomizing and entraining assembly 22 has the further advantage of enhancing the preparation thereby of the fuel and air mixture for quick, substantially complete combustion. In accordance with another feature of the atomizing and entraining assembly 22, a valve 104 is provided in one leg 76' of the conduit 76 providing communication between the two "idle" bores 36 and the intake manifold 20' of the engine 20 for closing one of the two "idle" bores 36 to communication with the intake manifold 20′ when a selected heat factor of the engine 20, e.g., the temperature of the heated fluid flowing through the passageway 102, is exceeded. In this manner, the two "idle" bores 36 provide a type of automatic choke mechanism to provide a greater quantity of fuel and air to the engine 20 when it is cold and to automatically decrease such quantity of fuel and air once the engine 20 has warmed to a sufficient degree that it can operate at idle on the fuel and air mixture provided by one of the venturi passageways. The valve 104 may be operated in a conventional manner such as by an appropriate temperature sensor (not shown) associated with the radiator system of the engine or otherwise by an electrical switch (not shown) or the like.

From the above, it will be understood that during idling operation of the engine 20 it is undesirable to permit the vacuum draw of the engine 20 to be applied to the plenum 70 and thereby possibly effect the creation of an unnecessary additional fuel entrained airstream through some of the six venturi passageways associated with the plenum 70. To prevent the vacuum draw of the engine from application to the receiving and directing arrangement 24 and to the atomizing and entraining assembly 22, a butterfly valve 106 is provided in the conduit between the receiving and directing arrangement 24 and the intake manifold 20′ of the engine 20 immediately upstream of the location at the intake manifold 20′ at which the idle conduit 76 communicates with the intake manifold 20′ and is operatively associated with the accelerator pedal 108 of the engine 20 for closing of the butterfly valve 106 when the accelerator pedal 108 is not depressed and for opening of the butterfly valve 106 in response and relation to the depression of the accelerator pedal 108. In this manner, the vacuum draw of the engine 20 is permitted to effect operation of the valve arrangement 78 of the atomizing and entraining assembly 22 in the above-described manner only in direct relation to the need for additional fuel and air as determined by the operator of the engine 20. It will also be understood to be advantageous to regulate the volume of ambient air flowing into the atomizing and entraining assembly 22 in relation to the need therefor as determined by the partial vacuum in the engine 20. For this purpose, another butterfly valve 110 is provided in the cap 42 on the block 34 and is operably associated with a diaphragm-operated vacuum sensor 112 of a generally similar type to that of sensor 84 communicating through a tubular conduit 114 with the intake manifold 20′ of the engine 20. The butterfly valve 110 is mounted for pivotal opening and closing movement about a horizontal axis 110′ and a bar 116 is rigidly mounted exteriorly of the cap 42 to the axis 110′ for movement therewith, a spring 118 being attached to one end of the bar 116 to bias it to a position pivoting the butterfly valve 110 toward its closed position and an actuating link 120 extending from the vacuum sensor 112 to the other end of the bar 116 for effecting movement of the bar 116 to pivot the butterfly valve 110 toward its open position. In this manner, increases and decreases in the vacuum draw of the engine 20 are sensed at the intake manifold 20′ and effect respective opening and closing movements of the butterfly valve 110 thereby to regulate the volume of ambient air permitted to flow into the atomizing and entraining assembly 22 and through its venturi passageways in relation to the need for air and fuel as determined by the vacuum draw of the engine 20.

According to another feature of the present invention, the receiving and directing arrangement 24 includes an enlarged chamber 24′ of significantly greater volumetric area than the venturi passageways and the plenum 70 of the atomizing and entraining assembly 22 for reducing the velocity of the fuel entrained airstream from the atomizing and entraining assembly 22 to allow fuel droplets larger than the aforesaid small size to gravitationally separate from the airstream and to collect in the chamber while the small fuel droplets remain entrained in the airstream for direction to the engine 20 for efficient and substantially complete combustion therein. Four specific embodiments of the enlarged chamber are presently contemplated and illustrated and described herein. In each embodiment, the chamber is essentially tubular and elongate and, to enhance and better facilitate the separation of the large fuel droplets from the airstream, is arranged to cause the airstream to flow in one direction through the chamber and in another direction therefrom.

Figure 3:
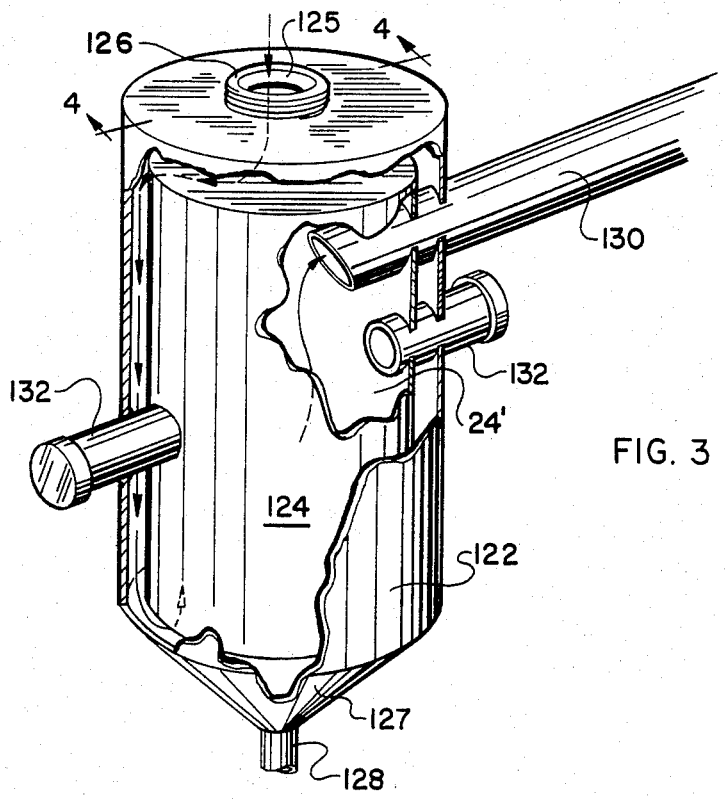
FIG. 3 is a perspective view of one preferred embodiment of the enlarged chamber of the airstream receiving and directing arrangement of the present invention.
Figure 4:
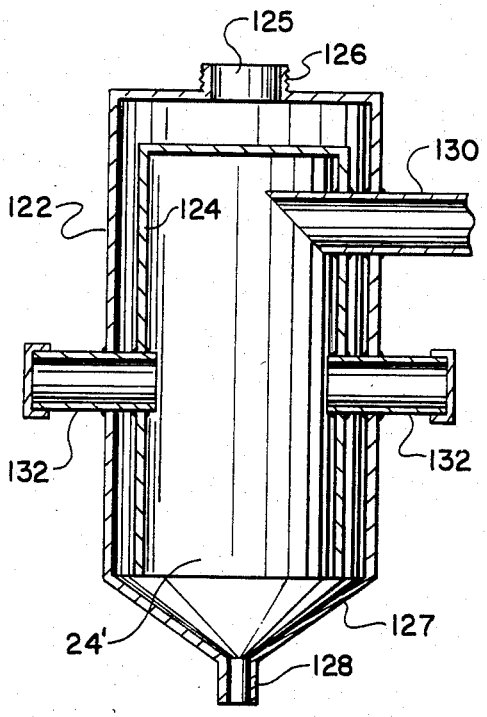
FIG. 4 is a vertical sectional view of the enlarged chamber of FIG. 3 taken along line 4—4 thereof.

With reference to FIGS. 1, 3 and 4, one embodiment of the enlarged chamber of the receiving and directing means is illustrated, the chamber of this embodiment being defined by a tubular exterior housing 122 oriented substantially vertically and within which is arranged an interior, inverted tubular baffle member 124. The exterior housing 122 is provided with an intake opening 125 in generally the center of the upper surface thereof surrounded by a threaded sleeve 126 to facilitate the affixation thereof on and communication thereof with the block 34 of the atomizing and entraining assembly 22 by its threaded collar 35. To facilitate the aforesaid collection of separated larger fuel droplets, which will hereinafter be more fully described, the lower end of the housing 122 formed as a funnel 127 tapering downwardly to a small spout-like opening 128. The interior baffle member 124 is closed at its upper end and open at its lower end, an exhaust pipe 130 extending generally horizontally through the housing 122 and the baffle member 124 to substantially the center thereof for exhaustion of the fuel entrained airstream from the chamber and direction thereof to the engine 20. In this manner, the fuel entrained airstream created by the atomizing and entraining assembly 22 is initially caused to flow substantially downwardly in the chamber in the annular space between the housing 122 and the interior baffle 124 and then to flow upwardly within the interior baffle 124 to be exhausted and conveyed to the engine 20 through the exhaust pipe 130.

To best facilitate the aforementioned purpose of reducing the airstream velocity, the housing 122 and baffle member 124 are preferably relatively dimensioned such that the cross-sectional area of the annular space of the chamber between the housing 122 and the baffle member 124 is greater than the cross-sectional area of the outlet opening 70′ of the plenum 70 and the inlet opening 125 of the housing 122, and such that the cross-sectional area defined within the interior baffle member 124 is greater than that of the annular space, and further such that the total volume of the housing 122 exceeds considerably the volume of the venturi passageways and the plenum 70 of the atomizing and entraining assembly 22. For example, the housing 122 may preferably be constructed of a diameter of approximately six inches (6″) and an axial length of approximately ten inches (10″) to the tapered portion thereof forming its funnel 127, and the interior baffle member 124 is constructed of a five inch (5″) diameter and an eight inch (8") axial length and is positioned in the housing 122 coaxially therewith. In contrast, the plenum 70 is a substantially rectangular polyhedral opening of the approximate dimensions of six inches (6") in length, one and one-half inches (1.5") in height, and three inches (3") in width; the plenum opening 70' and the intake opening 125 of the housing 122 are approximately one and one-half inches (1.5") in diameter; and the bores 36 are no greater than one inch (1") in diameter and approximately two and one-half inches (2.5") in axial length, with the venturi passageways therein being of the above-described dimensions. It can thus be seen that the fuel entrained airstream of the atomizing and entraining means 22 is reduced in velocity and permitted to volumetrically expand upon entering the housing 122 and, upon reaching the lower portion of the housing, is further caused to flow into the baffle member 124 in a direction opposite to its initial direction of flow in the housing 122 and to additionally reduce in velocity and expand volumetrically. As will be understood from the teachings of elementary physics, the speed reduction and volumetric expansion of the fuel-entrained airstream in this manner will cause the larger, heavier particulate fuel droplets entrained in the airstream to be disentrained under the force of gravity and this effect will be enhanced by the essentially vertical direction of flow of the airstream within the baffle member 24.

The extension of the exhaust pipe 130 into the baffle member 124 prevents the withdrawal therethrough of larger droplets which may collect on the internal wall surface of the baffle member 124 and might otherwise be drawn through the pipe 130 by the exhausting airstream. Pressure relief valves 132 are provided to permit the release of excess pressure in the enlarged chamber which may occur, for instance, when an engine backfire occurs, the relief valves 130 including tubular members 134 extending through the housing 122 and opening into the baffle member 124 and having a friction-fitted cap 136 adapted to be forced off whenever the internal pressure in the chamber exceeds a selectively predetermined level.

Figure 9:
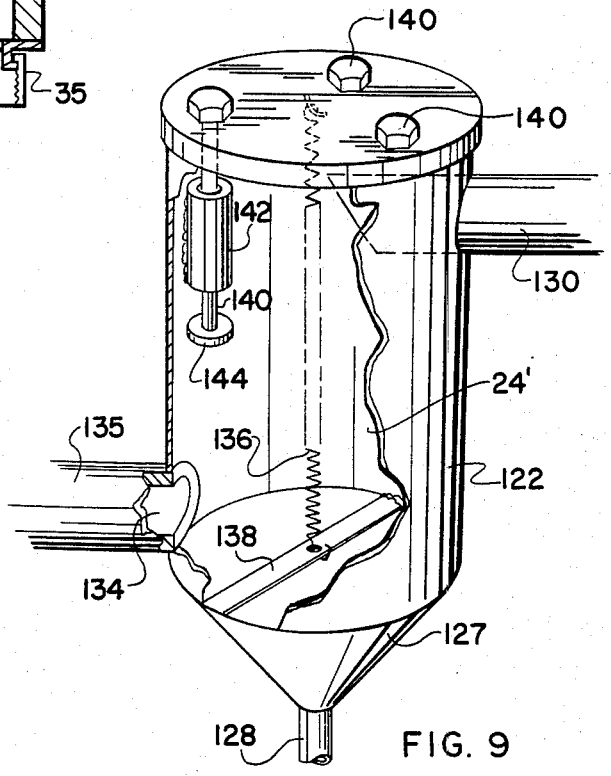
FIG. 9 is a perspective view of a second preferred embodiment of the enlarged chamber of the airstream receiving and directing arrangement of the present invention.

A second embodiment of the enlarged chamber is illustrated in FIG. 9 and represents a modified version of the enlarged chamber of the above-described first embodiment wherein the interior baffle member has been eliminated. The housing 122 is of substantially the same general construction as that of the first-described embodiment with the exception that its upper surface or cover has no intake opening 125, a horizontally-facing intake opening 134 being provided in the side wall surface of the housing 122 at the lower end thereof and communicating with an intake tube 135, whereby the airstream from the atomizing and entraining assembly is caused to flow substantially vertically upwardly from the lower end of the housing 122 to the exhaust pipe 130 at the upper end thereof and then horizontally therethrough. In this embodiment, the relief valves 132 are also eliminated and in their stead the top cover of the housing 122 is movably biased into sealed covering engagement with the cylindrical housing side wall by a spring 136 extending within the housing 122 between the cover and a transverse brace member 138 at the lower end of the housing 122. Three equally spaced guide bolts 140 extend downwardly from the underside of the housing cover at the periphery thereof through correspondingly spaced and located guide tubes 142 welded to the inner side of the cylindrical side wall of the housing 122 and are provided with lower stop members 144, whereby excessive pressure in the chamber is relieved by guided yielding movement of the housing cover away from the housing side wall, the stop members 144 of the guide bolts 140 preventing the loss or disorientation of the cover.

Figure 10:
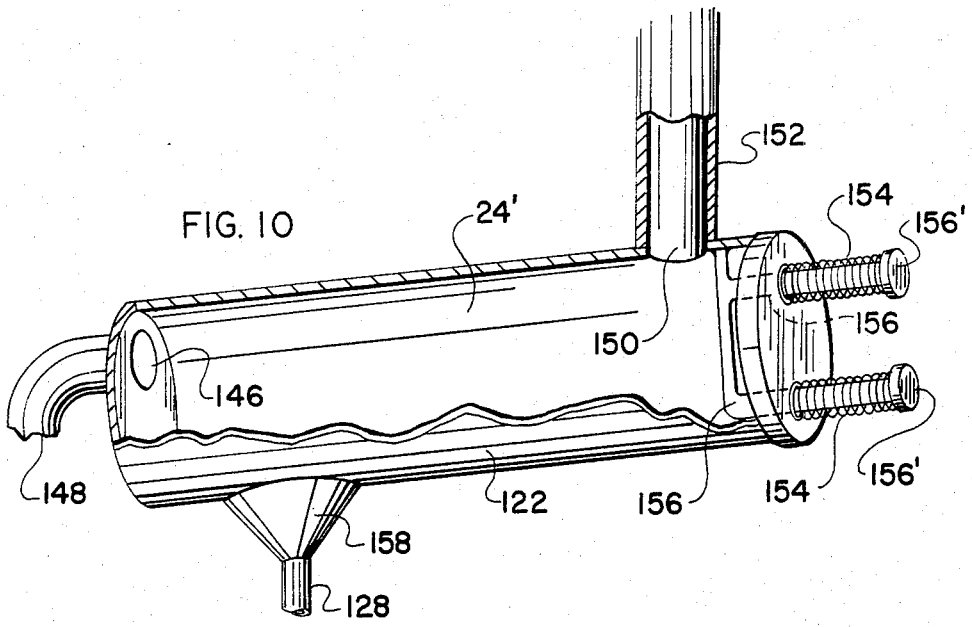
FIG. 10 is a perspective view of a third preferred embodiment of the enlarged chamber of the airstream receiving and directing arrangement of the present invention.

A third embodiment of the enlarged chamber is illustrated in FIG. 10 and is generally similar to that of FIG. 9 except that the housing 122 thereof is arranged substantially horizontally. An intake port 146 is provided in one end of the housing 122 and communicates with an intake pipe 148, an exhaust port 150 being provided in the upwardly facing surface of the cylindrical wall of the housing 122 in communication with a vertical exhaust pipe 152, whereby the airstream from the atomizing and receiving assembly 22 is caused to flow substantially horizontally through the chamber and vertically therefrom. The cover plate of the housing 122 at the opposite end thereof from the intake port 146 is arranged similarly to that of the cover plate of the above-described second embodiment, two guide rods 156 being affixed interiorly to the housing 122 and extending outwardly through the cover plate, the cover plate being biased into sealed engagement with the cylindrical wall of the housing 122 by springs 154 disposed about the guide rods 156 between the heads 156' thereof and the cover plate of the housing 122. As with the first and second described embodiments, the housing of this embodiment is provided with a droplet collection funnel 158 in the lower portion of the housing 122. Preferably, the housing 122 of this embodiment is arranged at a slightly downward incline toward the funnel 158 to facilitate the collection of the separated larger droplets in the funnel 158.

Figure 11:
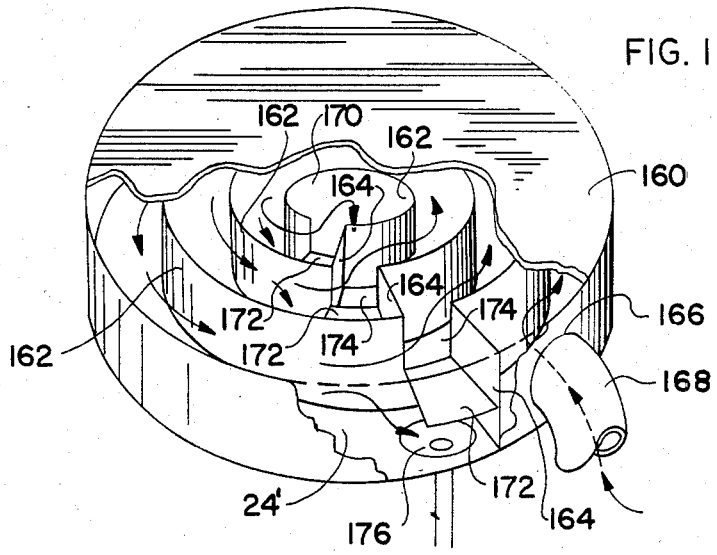
FIG. 11 is a perspective view of a fourth preferred embodiment of the enlarged chamber of the airstream receiving and directing arrangement of the present invention.

According to a fourth embodiment of the enlarged chamber illustrated in FIG. 11, the chamber is defined by a housing 160 arranged to define a plurality of airstream flow paths communicating for flow successively therethrough and then to the engine 20 of the airstream from the atomizing and entraining assembly 22. Preferably, the housing 160 is formed as a cylinder with a substantially greater diameter than axial height and is provided with a plurality of circular, concentric interior walls 162 radially spaced from the center of the housing 160 and axially extending the height of the housing 160 to form the aforesaid plurality of flow paths. A transverse end wall 164 extends in each flow path the radial width and axial height thereof to form a partition marking the beginning and ending locations of each flow path. The housing 160 is preferably arranged diametrically horizontal to cause the airstream from the atomizing and entraining assembly 22 to flow substantially horizontally, an intake port 166 opening to an intake tube 168 being provided in the outer cylindrical surface of the housing 160 adjacent one side of the end wall 164 of the radially outermost flow path for directing the airstream from the atomizing and entraining assembly 22 into such outermost flow path for flow therethrough in a counterclockwise direction as viewed in FIG. 11 and, to facilitate continued counterclockwise flow of the airstream successively radially inwardly through the remaining flow paths of the housing 160, the end walls 164 of the remaining flow paths are slightly staggered progressively clockwise from the end wall 164 of the outermost flow path radially inwardly to the end wall 164 of the innermost flow path and a baffle and port arrangement, indicated generally at 168, is located in each flow path intermediate the end wall 164 thereof and the wall 164 of the next succeeding, radially inward flow path. The inwardmost interior wall 162 defines an exhaust port 170 communicating through a pipe (not shown) or other appropriate means with the intake manifold 20' of the engine 20, the baffle and port arrangement 168 in the inwardmost wall 162 directing the airstream into such exhaust port 170. Each baffle and port arrangement 168 includes a horizontal baffle member 172 disposed substantially equidistantly of the axial height of its respective flow path and extending the width of the flow path clockwise from the end wall 164 of the flow path to adjacent the location in the next succeeding, radially-inward flow path of its end wall 164. A port 174 is provided in the interior wall 162 forming the radially-inward wall of each flow path above the respective baffle member 172 thereof to provide communication with the next succeeding, radially inward flow path.

It will therefore be understood that the chamber of the above-described fourth embodiment receives the fuel entrained airstream of the atomizing and entraining assembly 22 through the intake port 166 and directs it counterclockwise along the radially outwardmost flow path, over the baffle member 172 thereof and through the port 174 thereof into the next succeeding, radially-inward flow path along which the airstream flows counterclockwise, the airstream flow progressing in this manner radially inwardly through the housing 160 successively along the plurality of flow paths thereof. In accordance with the present invention, the housing 160 is dimensionally constructed such that the cross-sectional area of each flow path is greater than the cross-sectional area of the intake tube 168 between the atomizing and entraining assembly 22 and the housing 160 and the total volume of the flow paths is greater than that of the airstream flow path through the atomizing and entraining assembly 22 whereby the fuel entrained airstream is reduced in velocity and volumetrically expanded through its flow through the housing 160 to cause the large droplets therein to gravitate downwardly in the airstream during its flow through the housing 160. Accordingly, as the airstream flows to the end of each flow path and passes over the baffle 172 and through the port 174 thereof into the next succeeding flow path, the large droplets which have gravitated downwardly in the airstream will be directed under and will collect beneath the baffle 172 of each flow path. As with the other above-described embodiments of the chamber of the receiving and directing arrangement 24, a collection funnel 176 is provided in the lower cover member of the housing 160 beneath each baffle member 172 for collection of the larger droplets conveyed beneath the baffle member 172 in the above-described manner. It is to be noted that, by virtue of the relatively extended overall length and substantial overall volume of the several flow paths of the housing 160 of the fourth embodiment and without any substantial increase in the airstream velocity through the housing 160, the larger, heavier fuel droplets entrained in the airstream will gravitationally move downwardly in the fuel entrained airstream over the length of the flow paths in any event, thereby enhancing the operation of the housing 160 of the fourth embodiment in the above-described manner. In accordance with this manner of operation, it is believed that the housing 160 of this embodiment can effectively function for its intended purpose in the above-described manner even with the cross-sectional area of the flow paths thereof substantially equal to or slightly less than the cross-sectional area of the intake tube 168.

In accordance with another feature of the enlarged chamber of the receiving and directing arangement 24 of the present invention, an arrangement is provided for recycling through the atomizing and entraining assembly 22 of the large fuel droplets separated and collected in the housing of the enlarged chamber. As will readily be understood, the recycling arrangement may be readily adapted to each of the above-described four embodiments inasmuch as each such embodiment provides substantially the same funnel-type member for collecting therein the separated large fuel droplets. The recycling arrangement includes a collection sub-chamber 178 (FIG. 2) which is constructed in the generally conventional manner of an ordinary float bowl and communicates through a tubular conduit 180 with the funnel or other collection member (not shown in FIG. 2) of the housing of the receiving and directing arrangement 24 for gravitational flow from the collection funnel to the sub-chamber 178 of the separated large fuel droplets. The collected fuel is transiently stored in the sub-chamber 178 for recycling, the sub-chamber 178 being operatively associated in a manner to be described with a supplemental fuel pump 182 of conventional construction for conveyance of the collected fuel in the sub-chamber 178 through a tubular conduit 184 to either return the fuel to the supply tank 28 or to convey it into conduit 30 to again be pumped to the atomizing and entraining assembly 22. The sub-chamber 178 has a float member 186 pivotally mounted therein on one vertical side wall thereof for pivotal movement in floating disposition at the upper level of the collected fuel contained in the sub-chamber 178. A conventional mercury position switch 188 is mounted on the upper surface of the float member 186 for sensing pivotal movement of the float member 186 caused by changes in the level of fuel in the sub-chamber 178, the switch 188 being operatively electrically associated in a conventional manner with a conventional electric relay 190 and a conventional solenoid-operated valve arrangement 192 for actuating and deactuating the relay 190 and the solenoid-operated valve arrangement 192 in response to sensed pivotal movements of the float member 186 such that the upward pivotal movement of the float member 186 affected by an increase in the level of fuel contained in the sub-chamber 178 will actuate the relay 190 to in turn energize a solenoid 192' and open a valve 192'' in the conduit 184 thereby to permit the pump 182 to convey some of the contained fuel from the sub-chamber 178 and downward pivotal movement of the float member 186 upon removal of a sufficient quantity of the contained fuel from the sub-chamber 178 de-actuates the relay 190, de-energizes the solenoid 192' and closes the valve 192' thereby to prevent operation of the pump 182.

To compensate for the quantity of fuel droplets separated from the fuel entrained airstream of the atomizing and entraining assembly 22 by the enlarged chamber of the receiving and directing arrangement 24, the fuel supply arrangement 26 and the atomizing and entraining assembly 22 are co-operatively arranged to feed to and entrain in the airstream an oversupply of fuel droplets sufficient to provide a predetermined proportionate quantity of small fuel droplets in the airstream. Additional pressure relief valves, such as relief valve 194 at the intake manifold 20' of the engine 20, may also be provided to permit the release of excessive internal pressure in the atomizing and entraining assembly 22 and in the receiving and directing arrangement 24 and may be of any appropriate conventional construction.

It will thus be understood that the present invention in contrast to all existing and prior apparatus for preparing a mixture of fuel and air for supply to an internal combustion engine, provides an apparatus of this type capable of preparing an appropriate fuel-air mixture virtually free of fuel droplets of a size too large for quick, efficient and substantially complete combustion thereof in the engine. The atomizing and entraining assembly 22 of the present invention provides a plurality of venturi passageways for creating acceleratively moving airstreams therethrough, the venturi passageways being significantly smaller in size and greater in number than conventional apparatus, having fuel-aspirating apertures of smaller than conventional size, and being arranged for limited idling communication with the engine and sequentially greater communication therewith as fuel and air are required, whereby the atomizing and entraining assembly 22 is operative to atomize liquid fuel into sufficiently small fuel droplets more effectively and in greater proportions than conventional apparatus and to better regulate the amount of the fuel and air mixture provided to the engine in relation to the need of the engine therefor. In conjunction with the atomizing and entraining assembly 22, the enlarged chamber of the receiving and directing arrangement 24 through which the fuel entrained airstream of the atomizing and entraining assembly 22 flows effect a reduction of the velocity and expansion of the volume of the airstream and causes the heavier, larger fuel droplets therein which are too large for quick, complete combustion in the engine to gravitationally separate from the airstream and collect in the chamber. Accordingly, it can be seen that these two aspects of the present invention are collectively effective to substantially eliminate large fuel droplets from the fuel and air mixture prepared and provided thereby to an associated engine, whereby the mixture is quickly and completely combusted in the engine providing significantly increased fuel economy while also minimizing harmful products of combustion.

The present invention has been described in detail above for purposes of illustration only and is not intended to be limited by this description or otherwise to exclude any variation or equivalent arrangement that would be apparent from, or reasonably suggested by the foregoing disclosure to the skill of the art.

I claim:

1. A method of preparing a mixture of a combustible liquid fuel and air for supply to an internal combustion engine, comprising the steps of:

(a) atomizing said fuel into droplets including droplets of a sufficiently small size for substantially complete combustion in said internal combustion engine and entraining said fuel droplets in a moving airstream, (b) providing conduit means for directing said fuel entrained airstream to said engine, said conduit means including an enlarged droplet separation chamber.

(c) conveying said fuel entrained airstream through said conduit means to said engine while separating therefrom fuel droplets larger than said small size, said separation chamber of said conduit means being of a selected cross-sectional area sufficiently enlarged in relation to the remainder of said conduit means for causing said fuel entrained airstream to expand volumetrically in said chamber to reduce the velocity of said fuel entrained airstream sufficiently to allow said larger droplets to separate gravitationally therefrom and to maintain the entrainment therein of said small droplets for direction to said engine for efficient and substantially complete combustion in said engine, said conveying including withdrawing said fuel entrained airstream from said chamber at a location therewithin spaced inwardly from the walls thereof, and (d) collecting said separated larger fuel droplets, removing said separated larger fuel droplets from said separation chamber and recycling said larger fuel droplets by reatomizing them and entraining them in said airstream in advance of said separation chamber.

2. A method of preparing a mixture of a combustible liquid fuel and air according to claim 37 and characterized further in that said separating includes causing said fuel entrained airstream to flow in one direction through said chamber and in a different direction in flowing therefrom to enhance said reduction of airstream velocity and thereby facilitate separation from said airstream of said larger droplets.

3. A method of preparing a mixture of a combustible liquid fuel and air according to claim 2 and characterized further in that said causing includes causing said fuel entrained airstream to flow generally vertically through said enlarged chamber and generally horizontally therefrom.

4. A method of preparing a mixture of a combustible liquid fuel and air according to claim 3 and characterized further in that said conveying includes causing said fuel entrained airstream to enter said chamber transversely thereof adjacent the lowermost end thereof.

5. A method of preparing a mixture of a combustible liquid fuel and air according to claim 2 and characterized further in that said causing includes causing said fuel entrained airstream to enter said chamber generally at one end thereof, and to flow initially toward the opposite end thereof and subsequently toward said one end thereof.

6. A method of preparing a mixture of a combustible liquid fuel and air according to claim 1 and characterized further in that said atomizing and entraining includes creating an acceleratively moving airstream by drawing ambient air through a venturi passageway and emitting said fuel into said ambient air at said venturi passageway.

7. A method of preparing a mixture of a combustible liquid fuel and air according to claim 6 and characterized further in that combustion of said fuel in said engine and exhaustion of the products of combustion from said engine create a partial vacuum in said engine for drawing thereinto said fuel entrained airstream, said creating including providing a plurality of said venturi passageways and opening and closing said plurality of venturi passageways in a predetermined sequence in relation to increases and decreases, respectively, in said partial vacuum and said emitting includes aspirating said fuel into said ambient air in said open venturi passageways.

8. A method of preparing a mixture of a combustible liquid fuel and air according to claim 1 and characterized further by providing to said engine a supplementary fuel entrained airstream for idling operation of said engine.

9. A method of preparing a mixture of a combustible liquid fuel and air according to claim 1 and characterized further by supplying said fuel for said atomizing and entraining, said supplying and said atomizing and entraining cooperatively including providing an oversupply of fuel droplets in said airstream to provide a predetermined proportionate quantity of said small fuel droplets in said airstream thereby to compensate for separation of said larger fuel droplets from said airstream.

10. A method of preparing a mixture of a combustible liquid fuel and air according to claim 1 and characterized further in that said supplying includes pumping said fuel from a supply, transiently storing said pumped fuel at a storage location, and gravitationally feeding said stored fuel from said storage location for said atomizing and entraining of said stored fuel, said storing including regulating the admittance of said pumped fuel to said storage location in relation to the rate of gravitational feeding of said stored fuel therefrom.

11. A method of preparing a mixture of a combustible liquid fuel and air according to claim 1 and characterized further by providing an exit tube extending outwardly from said withdrawing location within said chamber, and shaping the end of said exit tube within said chamber to face the direction of conveyance of said airstream therewithin.

* * * * *